United States Patent [19]

Krings

[11] 3,969,852

[45] July 20, 1976

[54] SELF-SUPPORTING SHEETING PANEL FOR TRENCHES OR THE LIKE

[76] Inventor: Josef Krings, Hans-Boeckler Str. 23, D 5138 Heinsberg, Oberbruch, Germany

[22] Filed: Sept. 4, 1974

[21] Appl. No.: 503,091

[30] Foreign Application Priority Data

Sept. 12, 1973 Germany ..... 2345859

[52] U.S. Cl. ..... 52/155; 52/309; 52/404; 52/659; 61/41 A

[51] Int. Cl.[2] ..... E02D 5/74; E04H 17/22

[58] Field of Search ..... 52/309, 659, 404, 580, 52/155; 61/41 A

[56] References Cited

UNITED STATES PATENTS

| | | | |
|---|---|---|---|
| 1,590,302 | 6/1926 | Lindenlauf | 61/34 X |
| 2,677,955 | 5/1954 | Constantinesco | 52/659 X |
| 2,858,580 | 11/1958 | Thompson et al. | 52/309 X |
| 3,161,267 | 12/1964 | Keller | 52/615 |
| 3,331,174 | 7/1967 | Wesch et al. | 52/309 |
| 3,484,331 | 12/1969 | Betz | 52/309 X |
| 3,782,126 | 1/1974 | Pavese | 61/41 A |
| 3,810,337 | 5/1974 | Pollard | 52/309 X |
| 3,828,502 | 8/1974 | Carlsson | 52/309 |
| 3,858,399 | 1/1975 | Krings | 61/41 A |

*Primary Examiner*—Alfred C. Perham
*Attorney, Agent, or Firm*—Diller, Brown, Ramik & Wight

[57] ABSTRACT

A sheeting panel for trenches formed of a rectangular frame and a pair cover plates which collectively define a chamber housing foam plastic reinforced by steel cord mesh or steel cord waste thereby providing the sheeting panel with inherent strength to resist loads placed thereon by earth when the sheeting panel is used for shoring trenches or the like.

4 Claims, 2 Drawing Figures

SELF-SUPPORTING SHEETING PANEL FOR TRENCHES OR THE LIKE

The present invention is directed to a self-supporting sheeting panel for shoring trenches during, for example, the laying therein of pipes, cables or the like, the sheeting panel being formed of a generally rectangular frame, and a pair of covering panels fastened thereto forming a chamber or a plurality of chambers filled with metallically reinforced plastic foam. By this construction the sheeting panel has exception strength in both its horizontal and transverse planes which is a prerequisite for trench sheeting panels and at the same time has low weight, high corrosion strength, low manufacturing costs, and low friction as is desirable for removing the sheeting panel from the soil or earth after pipes, conduits or the like have been positioned in the trench between the sheeting panels and covered with soil.

Prior problems not providing the advantages last mentioned have been solved by the present invention by reinforcing the plastic foam within the frame and between the cover plates of the sheeting panel by steel cord mesh or steel cord waste. It has been shown that such reinforcing material provides considerable improvement in the bending strength of the sheeting panel so that the plastic foam within the chamber or chambers of the sheeting panel acquires the characteristic of a structural bearing component. This construction also makes it possible to manufacture sheeting panels of varied wall thicknesses depending on the particular load to which they might be subject and in any case each individual sheeting panel due to this metallically reinforced plastic foam becomes a self-supporting member.

The frame of the sheeting panel preferably is constructed of metallic material, such as steel, but advantageously the frame is constructed as light as might be needed due to the fact that the plastic foam within it and the cover plates provides reinforcement and therefore a lesser amount of frame steel is required than in conventional sheeting panels. Preferably the frame is constructed of a pair of U-shaped beams along each side, and spanning the frame are U-shaped beams secured in back-to-back relationship thus imparting a generally H-shaped transverse cross-section thereto. The frame is not intended as a rigidifying or reinforcing structure as the strength of the panel is determined by the beams arranged internally thereof in the H-cross-section heretofore described. By in this manner reducing the weight of the frame the overall strength is not impaired due to the U-shaped beams in back-to-back relationship and the plastic foam material within chambers formed thereby.

The cover plates are constructed from relatively inexpensive and thin material as, for example, a reinforced plastic such as synthetic polymeric or copolymeric resins sprayed on fibre glass mats. However, alternatively the cover plates may be constructed from sheet steel or steel plate, and in the latter case the steel plate is positioned against the earth or soil of a trench since it is particularly suitable for absorbing the spreading forces acting perpendicular to the sheeting panel. In the latter case it is assumed that the remaining cover plate which is disposed on the interior of the trench is not constructed of steel plate or steel sheeting.

With the above and other objects in view that will hereinafter appear, the nature of the invention will be more clearly understood by reference to the following detailed description, the appended claimed subject matter, and the several views illustrated in the accompanying drawing.

IN THE DRAWINGS

Figure 1:
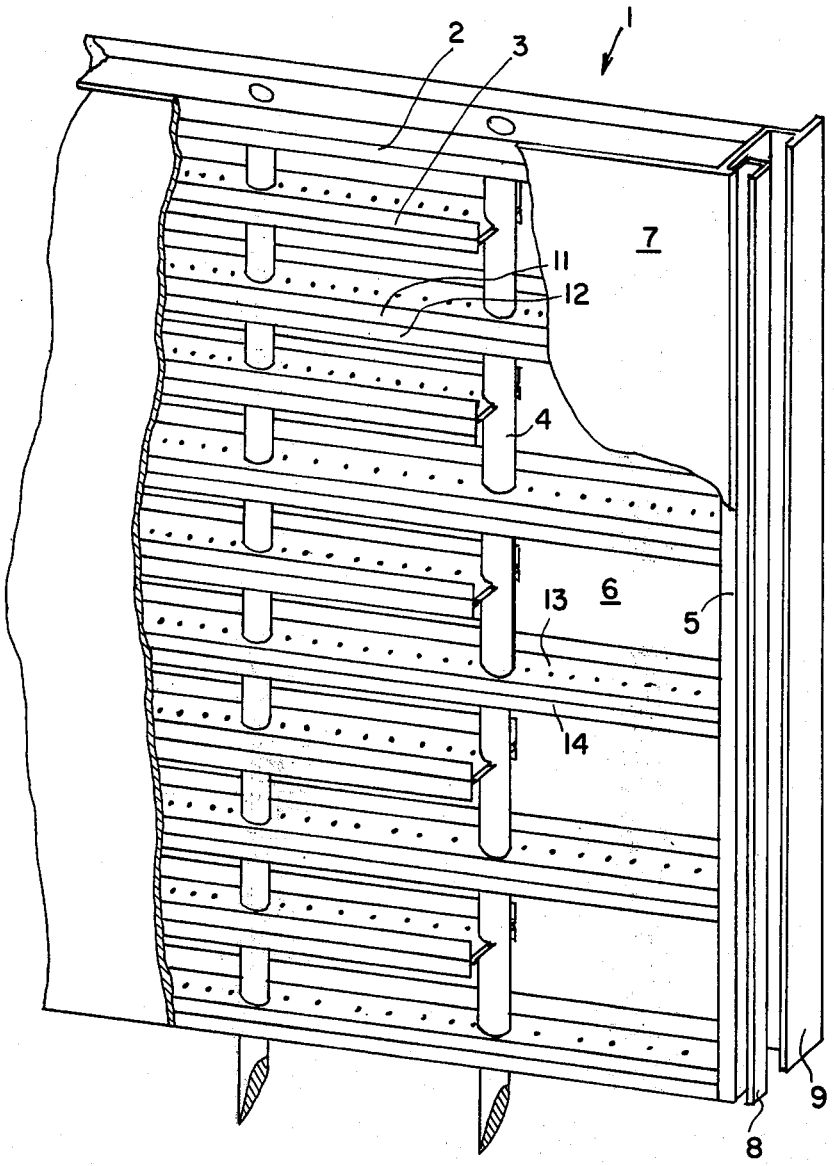
FIG. 1 is a fragmentary perspective view with portions broken away for clarity of a novel sheeting panel of this invention and illustrates the generally rectangular configuration thereof with a plurality of U-shaped beams secured to each other in back-to-back relationship to form a pluraity of chambers or chamber sections within the sheeting panel.

A novel sheeting panel, generally designated by the reference numeral 1 (FIG. 1) consists of horizontal I-beams or sections 2,3 which are apertured to receive therethrough vertical tubes which are welded or otherwise secured thereto. The I-beams 2,3 span the length of the sheeting panel 1 and are welded to opposite vertical beams 5, only one of which is illustrated. Generally rectangular cover plates 6,7 are welded or otherwise fastened to the overall frame of the sheeting panel 1 which is defined by the beams 2,3,5 and the remaining beam, corresponding to the beam 5, which is not illustrated in the drawings. The cover plates are constructed of reinforced plastic, such as synthetic polymeric or copolymeric resin which is sprayed on fiber glass mats or simply plates or sheets of steel. As an alternative construction one of the cover plates may be constructed from steel and theother from non-metallic material, such as the synthetic resin sprayed fiber glass mat heretofore noted. In the latter case the cover plate constructed of the plastic material, when in use, is positioned with the plastic facing the soil or earth of the trench wall while the sheet steel cover plate is on the opposite side facing the interior of the trench. The plastic is of a low coefficient of friction and permits the sheeting panel to be readily removed from the trench after the laying of pipe, cable or the like therein and the subsequent and progressive refilling of the trench up to initial ground level.

Guide pieces 8,9 in the form of channels are welded to the vertical beams 5 at each opposite side of the sheeting panel 1 so that the latter can be guided vertically relative to posts or columns which are driven into the soil.

Figure 2:
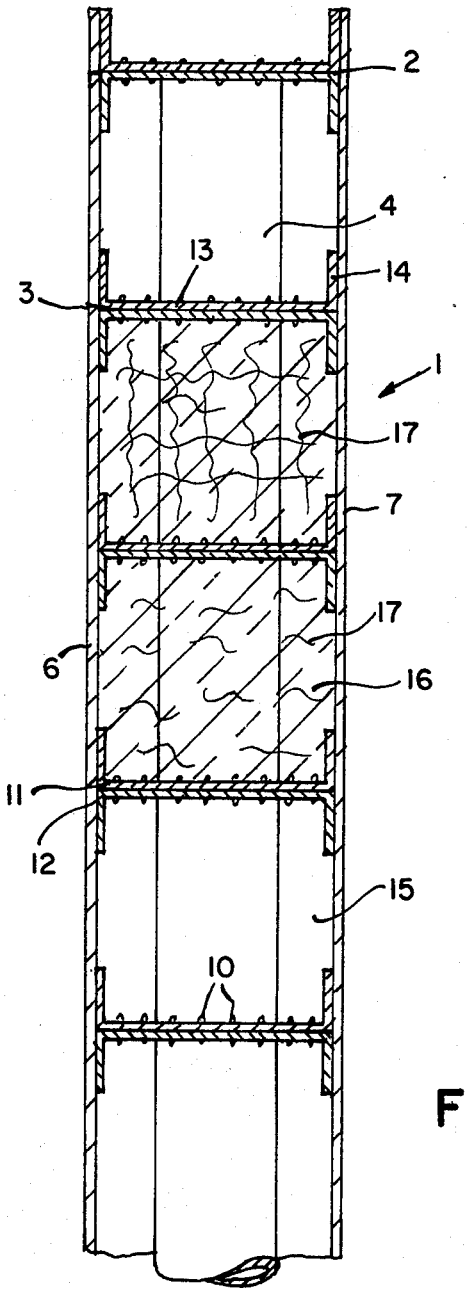
FIG. 2 is an enlarged fragmentary vertical sectional view taken through the sheeting panel of FIG. 1, and more clearly illustrates the back-to-back relationship of the beams and in the manner in which metallically reinforced foam plastic fills the chamber sections to impart rigidity to the sheeting panel.

Referring specifically to FIG. 2 of the drawings, the I-beams 2,3 and other like I-beams therebetween are formed by U-shaped channels or beams 11,12 placed back-to-back and spot welded to each other, as is indicated by the reference numeral 10. Thus each pair of U-beams 11,12 form a web 13, the thickness of which determines the static strength of the sheeting panel 1. Due to this construction the sheeting panel 1 can be made as strong as desired by selecting appropriate cross-sectional thicknesses of the U-beams 11,12 or by interposing intermediate layers between the same prior to the welding thereof to each other. In this fashion flanges 14 of the U-shaped beams 11,12 need not be unnecessarily reinforced, as would be the case if thicker U-shaped sections were selected. It is therefore also possible to manufacture the beams 11,12 from sheet steel or reinforced plastic.

By the construction thus far described there is formed within the frame 2,3,5 and the cover plates 6,7, a chamber or a plurality of chamber sections generally designated by the reference number 15 with each containing foam plastic 16 having embedded and thereby reinforced reinforcing means 17 of steel cord waste or steel cord mesh. The reinforcing means 17 thereby makes it possible to reduce the number of frame members 13 because the reinforced foam 16 derives considerable properties of strength from its reinforcement and isolation within the covering sheets 6,7. The foam may be poured in situ within the chambers 15 or manufactured separately and then inserted into the chambers 15 prior to both being closed by the covering sheets 6,7.

Though only two of the chambers 15 are shown containing the reinforced foam plastic 16, it is to be understood that the remaining chambers of FIG. 2 and all of those shown in FIG. 1 contain such foam plastic 16 reinforced by the steel cord 17.

While preferred foams and arrangements of parts have been shown in illustrating the invention, it is to be clearly understood that various changes in detail and arrangement of parts may be made without departing from the spirit and scope of this disclosure.

I claim:

1. A sheeting panel for trenches or the like comprising a generally rectagular frame, said frame being defined by horizontally disposed spaced parallel beams and vertically disposed spaced parallel beams, a plurality of horizontally disposed spaced parallel reinforcing members disposed between said horizontal beams and defining therewith a plurality of chambers, said reinforcing members being fixed to said vertical beams, a plurality of vertically disposed spaced parallel tubes disposed between said vertical beams, said tubes being fixed to said horizontal beams, a pair of cover plates secured to opposite faces of said frame beams, foam plastic filling said chambers, reinforcing means embedded in said foam plastic whereby the sheeting panel is reinforced for resisting loads placed thereon by earth when used for shoring trenches or the like, said reinforcing means consists of steel cord waste, vertically extending channel guide means secured to each vertical beam for vertically guiding the sheeting panel relative to posts associated therewith in a trenching environment, and each guide channel means being a vertically extending guide channel defining a generally U-shaped opening which faces laterally outwardly of said sheeting panel.

2. The sheeting panel as defined in claim 1 wherein said reinforcing members are U-shaped channels secured together in back-to-back relationship, apertures in bight portions of said channels, and said tubes pass through said apertures.

3. The sheeting panel as defined in claim 1 wherein said tubes have ends passing through the lowermost of said horizontal beams for penetrating the earth when said sheeting panel is disposed in a trench.

4. The sheeting panel as defined in claim 1 wherein said horizontal beams are I-beams, said reinforcing members are U-shaped channels secured together in back-to-back relationship, apertures in bight portions of said channels, and said tubes pass through said apertures.

* * * * *